United States Patent [19]

Hersey

[11] Patent Number: 4,826,159

[45] Date of Patent: May 2, 1989

[54] EXERCISE KIT, INCLUDING BALANCING DEVICE AND METHOD OF USING SAME

[76] Inventor: Michael G. Hersey, 251 W. Lincoln, Escondido, Calif. 92026

[21] Appl. No.: 80,632

[22] Filed: Jul. 31, 1987

[51] Int. Cl.[4] ..... A63B 23/04

[52] U.S. Cl. ..... 272/146; 272/114

[58] Field of Search ..... 272/111, 114, 146, 109

[56] References Cited

U.S. PATENT DOCUMENTS

| | | | |
|---|---|---|---|
| 2,764,411 | 9/1956 | Washburn Jr. | 272/146 |
| 2,930,613 | 3/1960 | Katz | 272/114 |
| 3,389,910 | 6/1968 | Kanzler, Jr. | 272/146 |
| 4,147,828 | 4/1979 | Heckel et al. | 272/109 |
| 4,191,371 | 3/1980 | Armer, Jr. | 272/146 |

*Primary Examiner*—Richard J. Apley

*Assistant Examiner*—J. Welsh

*Attorney, Agent, or Firm*—Bernard L. Kleinke

[57] ABSTRACT

A balance board device and kit, as well as a method of using it, for allowing, without any readjustment assembling or manipulation, a rocking, rolling and rotating motion, even up to 360° movements. The device includes a foot engageable board and a roller, and can be combined into an amusement, recreation and exercise kit, which includes a mat to enable the balance device to be used in almost any location, and provides increased safety to the user. The board has rounded ends, and a pair of rounded, small stops are mounted on the underside of the opposite ends of the board to limit back and forth movement of the board relative to the roller, and yet to permit clearance past the roller when the board is used to rotate in a horizontal plane relative to the roller.

10 Claims, 2 Drawing Sheets

EXERCISE KIT, INCLUDING BALANCING DEVICE AND METHOD OF USING SAME

TECHNICAL FIELD OF THE INVENTION

The present invention relates in general to an exercise kit and balancing device therefor, as well as a method of using it for amusement, recreation and exercise. The particular invention relates to the balancing device itself, which enables a wide variety of manipulations and feats to be performed, in a free style manner, while standing on it and maintaining ones balance.

BACKGROUND ART

Roller balancing devices of various types and kinds have been known in the art. Typically, such devices include a roller serving as a fulcrum, and a foot engageable balance board resting on top of the roller. However, all such prior known roller board devices, usually employed for amusement and/or exercise, are limited in their use and movement. They are primarily used for rolling or balancing, and their movement is limited to sideways rolling of the board relative to the roller, and/or a teeter-totter rocking motion. Therefore, these devices are somewhat limited in their use by virtue of their design.

Additionally, prior known roller balancing devices have been limited as to where they can be used safely. In this regard, when the rollers are used on a smooth surface, such as a tile floor, uncontrollable rolling can occur. Thus, the conventional devices are usually only used where frictional surfaces, such as carpeted surfaces, are available.

Therefore, it would be highly desirable to have a kit and balancing device therefor, which may be used in many more locations and which would allow much more freedom of movement.

A roller board device relating to a game of balance has been described in U.S. Pat. No. 2,764,411. The described device includes a rectangular flat foot engageable board balanced on, and supported by, a cylindrical roller, having a central groove therein. A guide rail fits in the groove to limit the motion of the board relative to the roller, to either a side-to-side reciprocation, or to a teeter-totter movement. The longitudinal travel is limited to the movement between a pair of strips forming a pair of end stops, which extend transversely to the underside of the board along its entire transverse side length.

This device has several disadvantages, and in some instances, it may be dangerous to the user. Not only is the movement limited to longitudinal movement, but the person operating such a board may sustain injuries by being thrown accidentally from the board when, during fast movement, the person abruptly hits the ground with the end stops. Thus, the speed with which this device is used is limited to slow, deliberate longitudinal rolling, to and fro. It is not able to be used in a vigorous, and yet creative manner.

Moreover, the patented board has a rectangular shape with sharp corners which can damage nearby objects, or can injure other people standing nearby. The end stops may strike the ground inadvertently, and once the end stop touches the ground, the user can be dislodged abruptly from the board, and thus the user can sustain injuries. Such board device is not designed for fast, free-style intense movement, and thus any such movement should be avoided with such a device.

It would, therefore, be desirable to have a device which would be more versatile to use and yet safe for fast paced, free-style movement, and thus lend itself to free style, imaginative feats.

A toy device comprising an exercising teeter board for longitudinal rotation on a rolling base is described in U.S. Pat. No. 3,995,852. The base is provided with a U-shaped circumferential groove receiving the undersurface of the teeter board. Two braking skids at the end of the U-shaped base apparently provide the safety features necessary to prevent a runaway of the roller base. This device is generally designed to be used by one or more persons in a sitting or standing position for rocking or rolling.

While perhaps safer than other conventional devices, this teeter board offers only limited longitudinal movement, preferably for safety reasons, and only gentle rocking and rolling motions are possible. Any vigorous use, in particular by two people, could lead to dislodging a person from the board or causing, if used in a sitting position, an injury to a foot caught under the board.

In any event, the patented teeter board does not enable any convenient, free movement of the board, other than longitudinal movement.

Along the same line, other prior known rollable balancing boards and devices disclosed in U.S. Pat. Nos. 4,505,477; 3,895,794 and 4,601,469, are limited in their movements and thus are not suitable for a more unlimited, free-style use.

A balancing fulcrum roller disclosed in U.S. Pat. No. 3,895,794 also has limited movability, because its fulcrum is confined rollably within a cavity disposed at the underside of a balancing board. The size of the cavity determines the range of the movement of the board relative to the roller. Moreover, the support for the feet is not flat, and therefore, the person using this device must stand in an awkward and unsafe position for the execution of more adept maneuvers.

Similarly, a balancing board device disclosed in U.S. Pat. No. 4,505,477 has limited movability determined by the length of a pair of tracks on the underside of the board, along which a pair of wheels roll forwardly or backwardly. This patented device is presumably intended to be an improvement over other balancing boards, by providing a means for control of the lateral movement of the board. Thus, such a board device would not at all be suitable for a wide variety of feats and a free style operation.

A balance board comprising roller-supported foot platform with a roller retained in the frame under the platform is disclosed in U.S. Pat. No. 4,601,469. A retaining pin or axle maintains the roller and foot platform in assembled relation, so that there is little or no possibility of relative movement between the roller and the board. The disadvantage associated with the last mentioned device is also its extreme lack of free, unrestrained movement.

A balancing exerciser platform with shock absorber means, useful as an exercise and amusement device, is disclosed in U.S. Pat. No. 3,416,792. The device includes a stationary base unit, which has a balancing board pivotally fixed on the upper position thereof. Therefore, the device can only be used to rock back and forth, and thus it does not allow any other relative movement of any kind between the board and its base.

Moreover, the device is stationary and not rollable, due to its design, and enables only a rather limited use.

An exercising device of the balancing type, capable of multiple modes of operation, would be highly desirable to provide amusement, as well as a good form of exercise. Such exercise would help promote agility and coordination.

A modified skate board permitting a freer movement by allowing forward, stopping, steering and maneuvering by the flexing of the ankle, is disclosed in U.S. Pat. No. 3,630,540. The patented skate board, used primarily for exercise, is designed to be ridden with one foot resting on it; and the other foot providing the motion by pushing off the ground. The board is mounted on a centrally located pair of rollers movable along a rail, and has a pair of rollers positioned at each end of the board. In this manner, the skate board can be used in a teeter-totter manner, but can be ridden in two positions only—with either the front or rear smaller wheels engaging the ground. Thus, such a device does not enable a wide variety of uses.

Hence, it would be desirable to have a balancing board device which would allow a wide variety of manipulations so that many different feats may be performed. Also, the device should be useable conveniently in many different locations.

DISCLOSURE OF THE INVENTION

The principal object of the current invention is to provide a new, improved versatile balance board device and kit, as well as a method of using same, useful in a wide variety of movement and manipulations to achieve many different free-style feats for amusement, recreation and exercise.

Another object of the current invention is to provide such an amusement, recreation and exercise kit including the balance board device and method, suitable for use in a wide variety of locations of use.

Briefly, the above and further objects of the present invention are realized by providing a balance board device and kit, as well as a method of using it, for allowing, without any readjustment or manipulation, a rocking rolling and rotating movements, including 360° rotations.

The device includes a foot engageable board and a roller, and can be combined into an amusement, recreation and exercise kit, which includes a mat to enable the balance device to be used in almost any location, and provides increased safety to the user. The board has rounded ends, and a pair of rounded, small stops mounted on the underside of the opposite ends of the board to limit back and forth movement of the board relative to the roller, and yet to permit clearance past the roller when the board is used to rotate in a horizontal plane relative to the roller.

The current invention is useful as an amusement, recreational and exercise device and, compared to previously known devices, provides several advantages.

Firstly, it is fully versatile in that it allows rolling motion, rocking motion and up to 360° rotation without any adjustment or other preparatory manipulation of the device.

The device and the kit is practical in that it can be stowed in a conventional bag or other convenient storage container, and thus can be stored easily. It is easily transportable in a conventional over-the-shoulder bag. It does not require any assembling, readjustment or manipulation.

The inventive device and kit provide easily controlled exercise, in that it is, if properly used, contained to the area of the mat, thus preventing injury to bystanders or to other people. Similarly, damage to walls and other objects is prevented by this containment to the limited area.

The kit is safe to use, in that it is preferably used on the anti-skid mat which has a coarse surface to prevent accidental running away motion. The stops are positionally adjustable on the board to enable the back and forth horizontal travel of the board to be adjusted according to the level of ability and skill of the user. Moreover, it provides straps for feet and/or handles for holding it to provide additional variations of use.

The board has generally a rectangular shape with rounded ends or oval shape so that it can move past nearby objects without striking them. In this regard, the board, when in use, is much less likely to strike the ground, a wall or some other object. Thus, the device does not tend to throw the user off the board even if it hits something. The shape also tends to prevent damage to the surroundings.

The adjustable stops, or limiting devices enable the user to limit the movement of the board relative to the roller, to an extent desired by the user. Also, the stops also function as a means of rotation.

Finally, the proper use of the device does not tend to cause, under normal conditions, an injury to the user's joints, knees and other bodily parts because the use is smooth and continuous. Halting the motion by means of the resilient stops engaging the coarse mat is much more gentle as compared to prior known devices.

BRIEF DESCRIPTION OF DRAWINGS

The above mentioned and other objects and features of this invention and the manner of attaining them will become apparent, and the invention itself will be best understood by reference to the following description of the embodiment of the invention, in conjunction with the accompanying drawings, wherein.

BEST MODE FOR CARRYING OUT THE INVENTION

Figure 1:
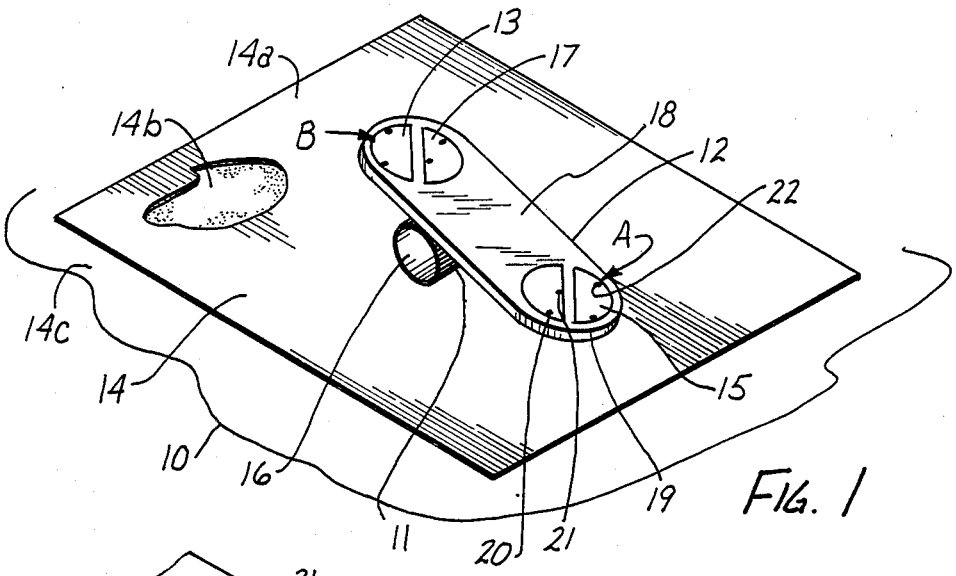
FIG. 1 is a pictorial view of an exercise kit comprising a mat and a balance board device which are constructed in accordance with the present invention.

Referring now to the drawings, and more particularly to FIG. 1 thereof, there is shown a recreational and exercise kit 10, which is constructed according to the present invention. The kit 10 generally comprises a roller board device 12 resting on top of a square mat 14 made of coarse fabric material 14A and having a rubber backing material 14B, which is adapted to rest on this and to overlie a suitable support surface 14C, such as the ground or a floor.

Centrally disposed on the mat 14 is positioned the roller board device 12. The device 12 includes a base roller 16 engaging with its coarse surface 11 the mat 14 and supporting rollably a foot engageable balance board 18 resting loosely and freely atop the roller 16. The board 18 has at its ends a pair of circular foot engageable friction pads 15 and 17, secured to the upper surface of the board. A pair of sets A and B on the respective pads 15 and 17 of attachment devices are each similar to one another. The set A generally comprises four space-apart similarly constructed D-ring device 19, 20, 21 and 22 to which either a strap 60, or, alternatively, a handle (not shown) can be attached to either secure the feet of the user to the ends of the board, or to enable the user to grasp and hold on to either end of the board.

Figure 2:
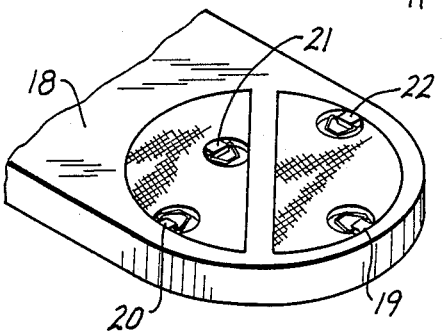
FIG. 2 is an enlarged, fragmentary pictorial view of an end portion of the board of FIG. 1.
Figure 3:
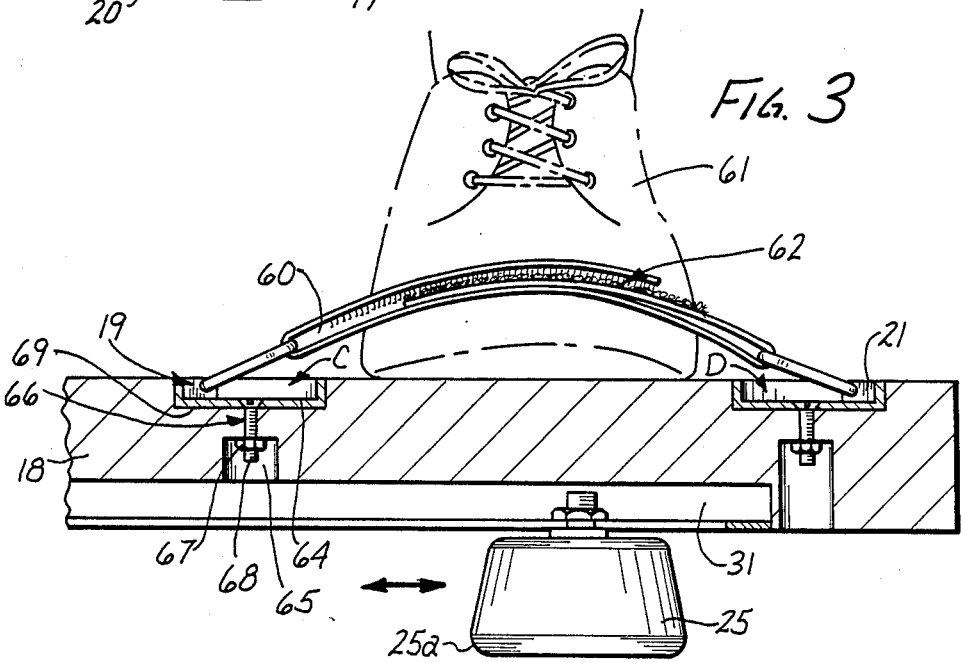
FIG. 3 is a greatly enlarged sectional view of the board end portion of FIG. 2, showing a foot strap in use, as indicated by the user's foot illustrated in broken lines.

As shown in FIGS. 2 and 3, the four D-ring devices 19, 20, 21 and 22 fit into similar countersunk openings, such as a pair of openings C and D (FIG. 3) in the upper surface of the board. The handle can be affixed removably to the transversely spaced-apart D-ring devices 20 and 22, to enable the handle to extend therebetween. As shown in FIG. 3, the strap 60 is affixed to the longitudinally spaced-apart D-ring devices 19 and 21 arranged on the central axis of the board. Alternatively, if desired, the strap 60 can be removed from the rings 19 and 21, and attached in a similar manner to the rings 20 and 22.

The other end of the board has an identical arrangement and either a similar strap (not shown or a handle (not shown), may be attached in the same way as indicated in FIG. 3.

As shown in FIG. 3, the strap 60 is attached to the longitudinally positioned D-ring devices 19 and 21. Strap 60 is adjustable in size to fit different size shoes, such as the shoe 61 of the user, by means of a fastening device, such as a Velcro attachment 62.

The D-ring devices 19 and 21 are fastened within respective countersunk openings C and D. Only the opening C will now be described in greater detail, since the opening D is similar to it. The opening C includes a cup shaped member 64 fastened within a countersunk opening 69, by means of a bolt 68 and a nut 67 extending between the opening 69 an a countersunk hole 65 on the underside of the board.

Figure 4:
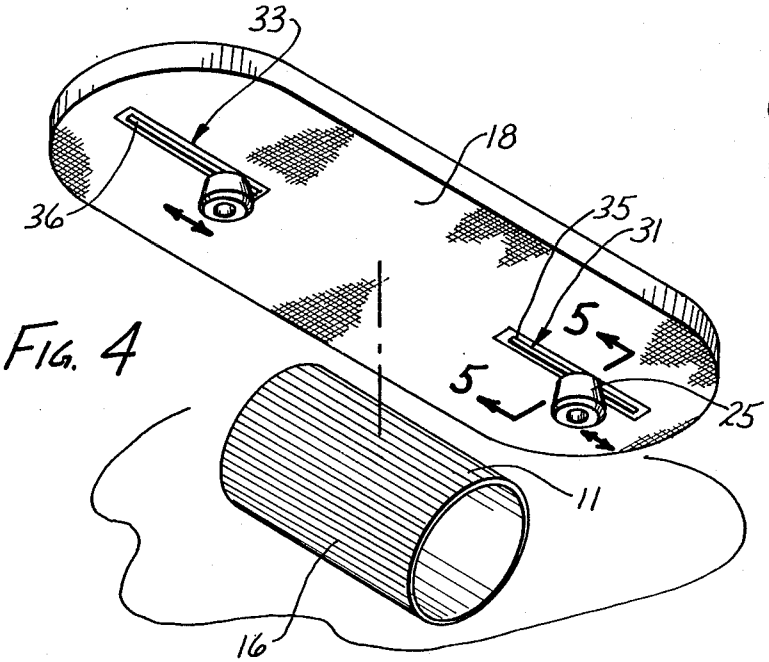
FIG. 4 is an enlarged pictorial view of the roller board device of the kit of FIG. 1, showing the underside of board with its positionally adjustable stops thereon.

As shown if FIGS. 3 and 4, a pair of tracks 31 and 33 extend longitudinally along the underside of the board for receiving the respective limiting device 25 and 23. The pair of similarly constructed limiting devices 23 and 25, are rotatably mounted on the underside of each end of the board 18, and are positionally adjustable along the respective tracks 33 and 31. The limiting devices are potentially adjustable by the user to determine the extent of the back and forth movement of the board 18 by the user relative to the roller. In this regard, the user standing on the board 18 can roll back and forth with the limiting devices engaging the roller at the extremes of each excursion.

The tracks 31 and 33 are channel shaped and composed of metal. The tracks are mounted flush on the underside of the board 18 and have slit-like openings, 36 and 35 respectively, through which the limiting devices 25 and 23 is attached to the board 18.

Figure 5:
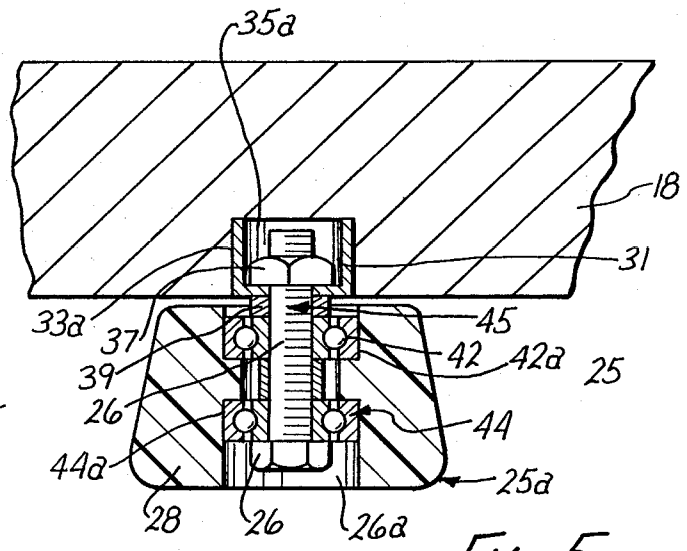
FIG. 5 is an enlarged, fragmentary sectional view of the board of FIG. 1, showing a stop or limiting device.

The limiting device 25 will now be described in greater detail in FIG. 5, and it is to be understood that the description equally fits the device 23. The limiting device 25 is attached to the board with nut 37 and bolt 26. The device includes a rubber roller 28, which is fastened removably to the track 31 by means of the bolt and nut. A opening 33A in the underside of the board 18 receives the track 31 to enable it to be mounted flush. The opening 35 in the track 31 receives a shank portion 45 of the bolt 26, and the nut 37 is threaded onto bolt 26 and positioned within a hollow recess 35A within the rack 31, to fasten the rubber roller 28 of limiting device 25 rotatably to the board 18.

The track 31 is generally channel shaped throughout its length. A spacer sleeve 39 surrounds the shank 45 of the bolt. A pair of thrust bearings 42 and 44 fit within enlarged portions 42 and 44A of a central axial opening 26A, to permit rotation of the moveable mounted rubber roller 28 relative to the bolt 26.

According to the invention, the board 18 is free of the roller 11, and thus can rotate in a horizontal plane about the roller 11. In this regard, with the user standing on top of the board, disposed in a horizontal plane resting freely on top of the transversely disposed roller 11, the user shifts his or her weight in a jerky maneuver, to rotate the board in a horizontal plane relative to the roller 11.

Such a rotational movement can be achieved through a 360° rotation by an adept user, since the limiting devices are relatively small and generally circular in bottom plane configuration. In this regard, the limiting devices are each disposed on the central longitudinal axis of the board, and are sufficiently small in size, so that the devices 23 and 25 do not tend to engage the roller during a rotational movement. Thus, the devices 23 and 25 do not tend to interfere with the rotational manipulation of the board, even if the roller is rolling back and forth to a limited extent as the board rotates thereabout. Thus, due to the free mounting of the board on the device, and due to the size, shape and positioning of the limiting devices on the board, the rotating movement can be accomplished by the user standing on the board 18, even when the roller is rolling back and forth at the same time.

Figure 6:
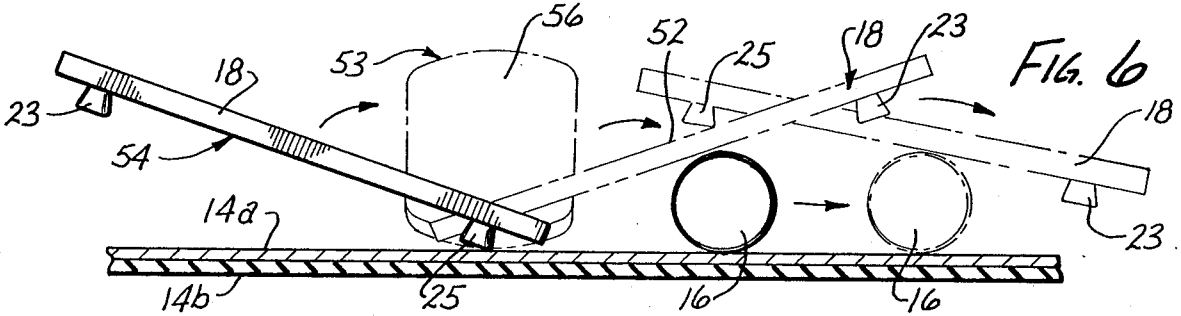
FIG. 6 is an elevational view of the board device, illustrating the board in the process of being held by the user (not shown) in an inclined position, with the other steps of the process being shown in broken lines, for mounting the board up onto the roller, while the user is standing thereon.

As shown in FIG. 6, an experienced user can mount the board up onto the roller, while the user is standing on the board. Using one of the limiting devices 23 and 25 to pivot about, the board 18 can be moved on top of the roller from an inclined disposition resting on one of the devices, such as the device 25, and the upper end pulled by the hand of the user, while the user's feet rest on top of the board. Starting at the position indicated generally in solid lines at 54, the upper end of the board is pulled by the hand of the user, through an intermediate position shown in broken lines at 56, until, as shown in broken lines at 52, the upper end of the board 18 rests on top of the roller 16. Thus, according to the invention, the limiting devices also serve the additional function of enabling the user to stand on the board 18, and swing the board up onto the roller 16, as indicated in broken lines at 50. Thus, such a feat adds to the variety of freestyle maneuvers capable to be performed by the device 12. The ability of the limiting devices to rotate about their axes, facilitates greatly the roller mounting feat, since the roller, such as the roller 25, used to pivot about, rests on the supporting surface and pivots rotatably as the rubber device 25 grips the supporting surface, such as the mat 14.

As best seen in FIG. 3, both limiting devices, such as the device 25, include beveled or rounded bottom edge to facilitate the roller mounting movement of FIG. 6. In this regard, the beveled edge 25A engages the supporting surface, when the movement of FIG. 6 is performed.

Considering now the base roller 16 in greater detail, it is a cylinder which is hollow and opened at either end. It has an inner diameter of between 2 and 9 inches and a width of between 10 and 14 inches. The width is substantially equal to the width of the board 18. The cylinder is made of plastic material, metal or wood, but may be made of any other suitable rigid material which can bear the weight of the board 18 and the user standing on top of it.

The surface 11 of the base roller 16 cylinder has a roughened out surface to facilitate the cylinder and the board engaging one another frictionally. The surface can be either roughened plastic material, or a frictional structure fabric material (not shown), with or without a rubber backing sheet (not shown), fastened to the outer surface of a metal cylinder (not shown).

The elongated, rectangular board 18 with semi-circular ends is made of wood, plastic, metal or any other suitable rigid material. In general, it is between 1.5 and 4 feet long, between 10 and 14 inches wide, and between 0.5 and 2 inches thick. Its undersurface is covered with the same coarse material 11 as used for the roller 16 to enable the board 18 and the roller 16 to grip one another frictionally.

The upper surface of the board 18 can be covered with the same coarse material, or it has two roughened circular pads or rings 13 at each end of the board permitting the grip between the feet 61 of the user and the board 18. Optionally, one or two straps 60 can be attached to these rings in transversal position, to be used as handles, or in longitudinal positions, to be used as the feet straps or binding.

The limiting devices 23 and 25 can be used for either restraining the extent of the longitudinal movement of the board relative to the base roller, for stopping the movement, or as a rotational point along which the rotation up to 360° can be made in a clockwise or a counterclockwise direction. The limiting devices 23 and 25 can be moved and adjusted along the tracks 31 and 33 allowing the shorter or longer distance for longitudinal movement adjustment is conveniently made with loosening and fastening of the bolts attaching the limiting devices 23 and 25 to the board 18 with their respective nuts.

The board has a generally rectangular shape with circular ends to allow for smoother riding and rotating and to avoid possible injuries to the user or to other people, or possible damage to adjacent walls, fences and other objects which may be hit with the board during its use. In this regard, the rounded ends do not have sharp corners which could damage nearby objects, or injure bystanders.

The mat 14 is generally a flat, coarse, fabric material, which is either woven or unwoven. It is made of woven or pleated hemp, rope, or any other suitable material which provides a roughened surface 11. The most preferred is the mat 14 which frictionally engages with the surface of the roller. Such mat 14 has a double function. It restrains the movement of the user to the area of the mat 14, thus preventing the injury to other people or damage to property. It also acts as the safety feature in that it engages the surface of the roller 16 with the surface of the mat 14 and tends to prevent the roller from sliding and slipping inadvertently away, and rolling away, with or without the user on board 18.

The use of the mat also enables the rotating movements on the board relative to the roller, by engaging the mat 14 surface with one of the limiting devices 23 or 25 and allowing the user to rotate the other end of the board around the mat 14/stopper 25 engaging point.

The kit 10 employing the mat 14, or the balancing device 12 itself, may be used by youngsters and by adults for amusement, recreation, acrobatics, exercise or, in certain cases, as the rehabilitation exercise. A smaller scaled-down kit (not shown) may be used for smaller children.

There are a variety of uses of the device 12, as well as the kit 14. The normally contemplated use is for rocking and rolling when the person stands on the roughened pads. Alternatively, his or her feet can be secured in the longitudinally positioned straps and, by movement of the body from side to side, the person rolls from side to side on the roller as it rolls along the mat, or directly on a supporting surface. By pushing on one and then the other leg, the person may engage in a rocking motion about the roller.

In another mode of operation, by pushing one foot on the ground to engage one of the limiting devices with the mat, and by swinging the body in a semicircular fashion while transferring the body weight on the other foot, and swinging the body, the person may rotate board 18 about the limiting device, until the board engages the roller.

Alternatively, the user may engage one foot as previously described and to hold with his or her hand to the other strap either longitudinally or transversely positioned, and rock and roll in the bending position.

Yet another contemplated use is for the exercise of the upper torso and shoulders by holding transversely positioned straps with the hands, and by rolling the board from side to side in smooth or circular movements to exercise various muscles in the back and shoulders.

The device also can be used for acrobatics in that the person holding the straps may stand on his or her hands, and then rock, roll or rotate in the same manner as previously described.

While a particular embodiment of the present invention has been disclosed, it is to be understood that various different modifications are possible and are contemplated within the true spirit and scope of the appended claims. For example, the footholds and handholds may be positioned in various different locations on the board, as desired. Also, the base roller may be in the form of a solid block. There is not intention, therefore, of limitations to the exact abstract or disclosure herein presented.

What is claimed is:

1. A balancing board device, comprising:

a base roller;

an elongated rectangular balancing board resting freely and rockably on top of said base roller;

a pair of movement limiting devices mounted on the underside of the board in a spaced apart manner and disposed substantially on the central longitudinal axis of the board to permit free rotational movement of the board with the user positioned on top thereof in a horizontal plane relative to the roller even as it rolls reciprocatively; and channel-shaped tracks for supporting said limiting devices in a positionally adjustable manner to enable the limiting devices to be adjusted positionally toward or away from one another.

2. The device of claim 1 wherein the limiting devices are rotatably mounted.

3. The device of claim 2, further including means defining holds on top of the board in a spaced apart manner.

4. The device of claim 3 wherein said means includes two pairs of D-ring devices countersunk fixedly into each longitudinal end of the board and arranged spaced apart longitudinally, and strap means for attaching releaseably to said D-ring devices.

5. The device of claim 4, further including holding means spaced apart on top of the board.

6. The device of claim 5, wherein said holding means includes two pair of D-ring devices on top of either end of the board.

7. The device of claim 4, wherein the base board has a roughened underside surface and two roughened circles on the longitudinal ends of the upperside of the board.

8. The balancing board device of claim 2 in combination with a mat to form a kit, wherein the mat has a roughened upper surface for engaging the roller frictionally.

9. The kit of claim 8 wherein said mat includes a sheet of coarse fabric material to serve as the roughened surface.

10. The kit of claim 9, wherein said mat includes a resilient backing sheet secured to said sheet of fabric material.

* * * * *